United States Patent [19]

Marzoli

[11] 4,280,321

[45] Jul. 28, 1981

[54] SAFETY SPINDLE-STOPPING DEVICE FOR A SPINNING FRAME

[75] Inventor: Angelo Marzoli, Palazzolo Sull'Oglio, Italy

[73] Assignee: F.lli Marzoli & C. S.p.A., Italy

[21] Appl. No.: 29,513

[22] Filed: Apr. 12, 1979

[30] Foreign Application Priority Data

Apr. 24, 1978 [IT] Italy ..... 22684 A/78

[51] Int. Cl.[3] ..... D01H 13/16

[52] U.S. Cl. ..... 57/81; 57/87; 57/89

[58] Field of Search ..... 57/78, 80, 81, 83, 86, 57/87, 89

[56] References Cited

U.S. PATENT DOCUMENTS

| | | | |
|---|---|---|---|
| 1,422,745 | 7/1922 | Cote et al. | 57/86 |
| 1,735,102 | 11/1929 | Arragg | 57/81 |
| 2,611,230 | 9/1952 | Saunders et al. | 57/87 |
| 3,002,333 | 10/1961 | Wright | 57/83 |
| 3,388,544 | 6/1968 | Hamel | 57/81 |
| 3,452,531 | 7/1969 | Watson | 57/86 |
| 3,498,039 | 3/1970 | Kent et al. | 57/86 X |
| 3,517,497 | 6/1970 | Rettenmund | 57/81 |
| 3,568,425 | 3/1971 | Zegna et al. | 57/81 |
| 3,841,076 | 10/1974 | Ford et al. | 57/83 |
| 4,030,281 | 6/1977 | Schopper et al. | 57/87 |

FOREIGN PATENT DOCUMENTS 1181064 2/1970 United Kingdom .

*Primary Examiner*—John Petrakes
*Attorney, Agent, or Firm*—Karl W. Flocks

[57] ABSTRACT

A device is disclosed, as an attachment to a spinning, or a doubling frame, for stopping the rotation of the spindle and the sliver feed whenever a sliver or a thread breaks and for giving, at the same time, a warning signal (e.g. a luminous signal) to a watching operator. The device comprises a thread feeling whisker connected to a circuit which controls electromagnetic clutches connected to the spindle, and the spindle braking and stopping mechanism is connected by a flexible cable to a sliver-pinching press so that as soon as the spindle is being braked and stopped the sliver is pinched and sliver feed is discontinued. The electric circuit also comprises an indicator lamp.

2 Claims, 9 Drawing Figures

1
2
3
4
5
6
7
8
9
10
11
12
13
14
16
19
20
21
24
27
29
30
33
57
58
59
60
61
62
63
64
65
66
+
−

Fig.3
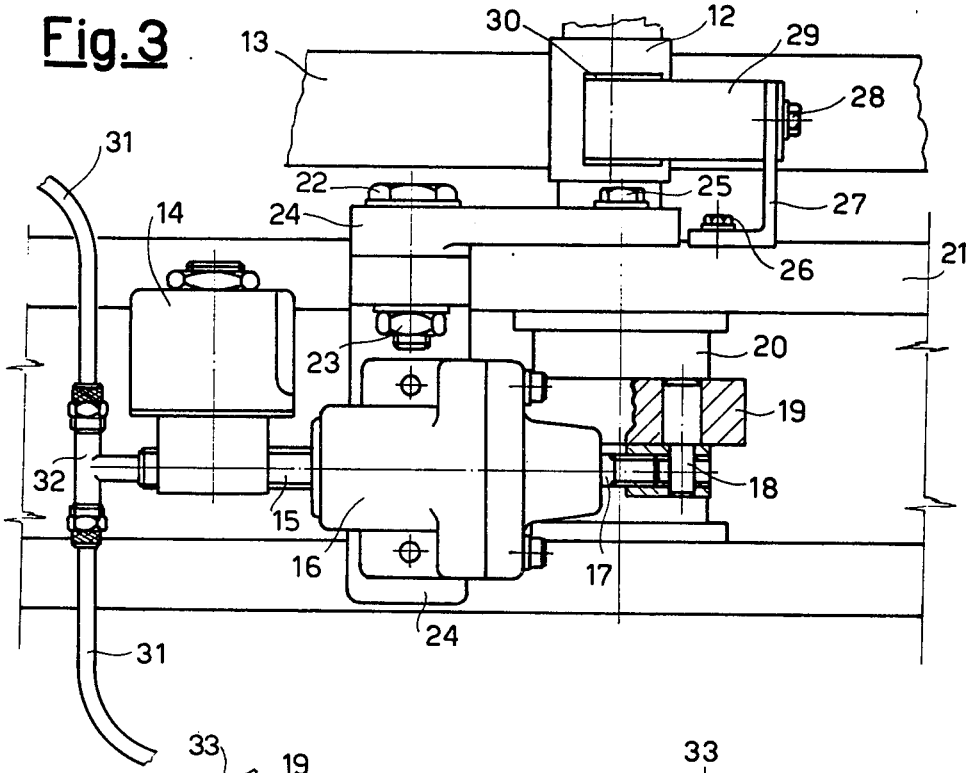
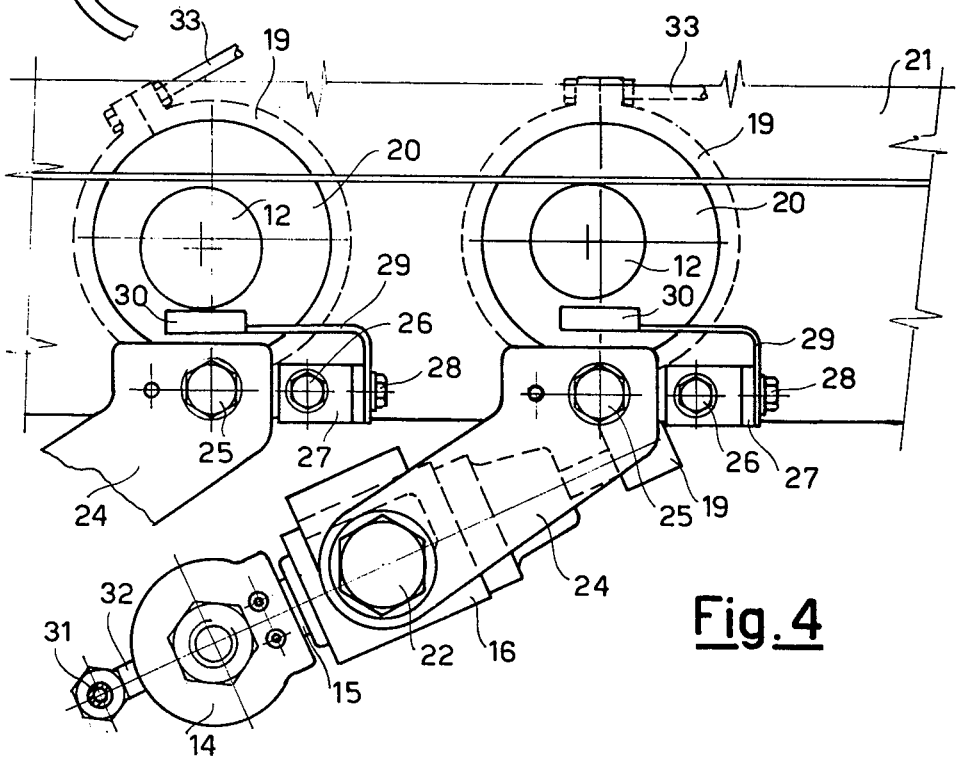
Fig.4

Fig. 6
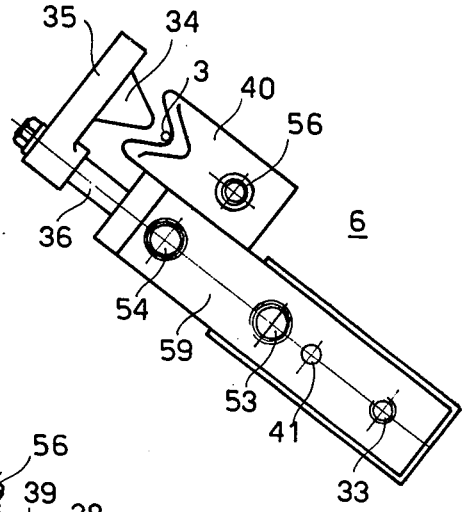
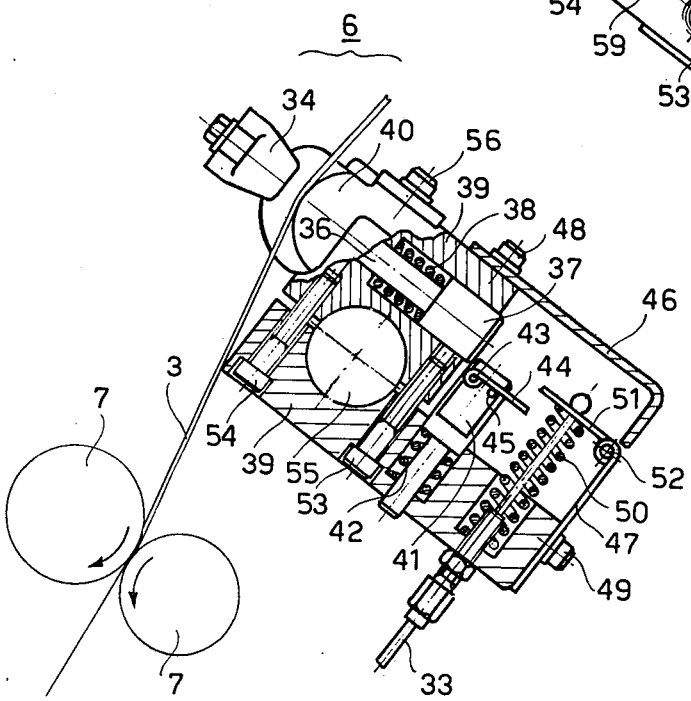
Fig. 5

Fig.7
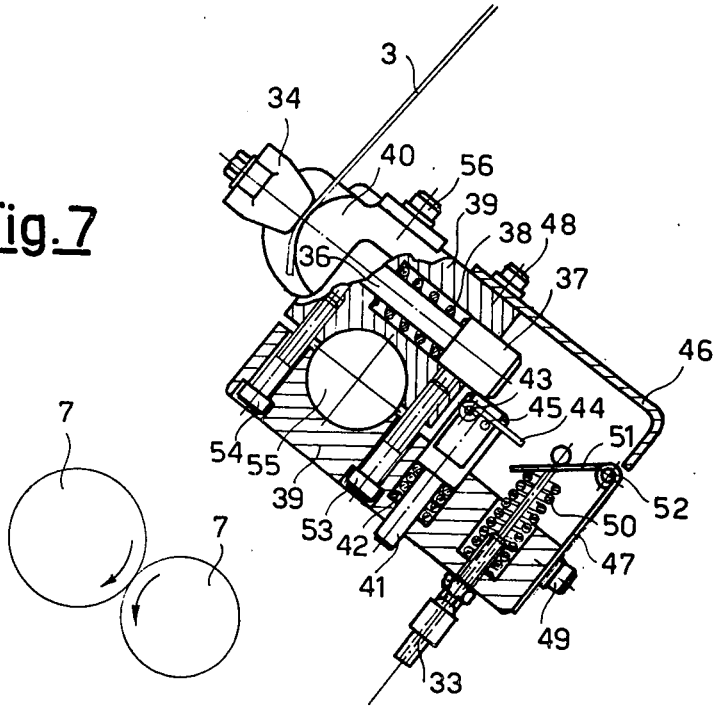
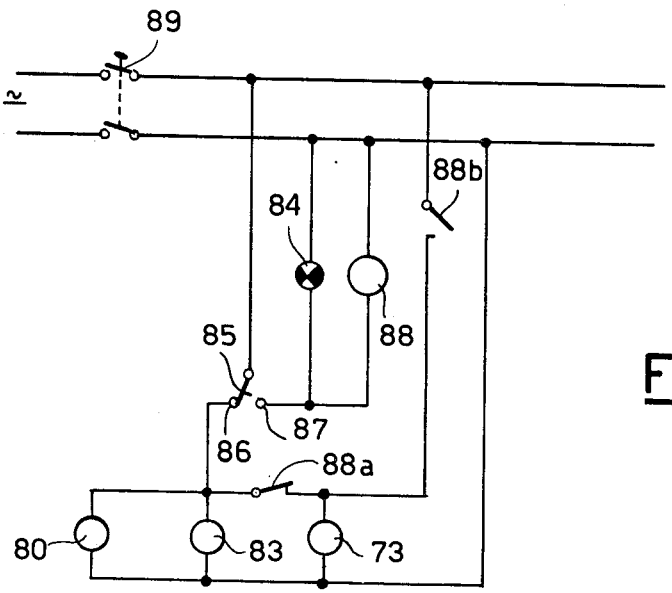
Fig.9

SAFETY SPINDLE-STOPPING DEVICE FOR A SPINNING FRAME

This invention relates to a device which can be applied to spinning frames for carrying out, independently for each active position, stopping of the spindle as well as the stop of feed whenever, during the operation of the machine, a thread breakage or a tow breakage occurs in the zone between the drafting unit and the collection area, and for signalling to an operator the occurrence of such a breakage.

It is known that in the spinning frames, in operation, whenever a thread or tow breakage occurs in the zone between the drafting unit and the spindle, it may happen that the end of the broken thread or tow, due to the rotation of the spindle, may become engaged in the traveler which rides on the ring or the flyer and cause fraying. The fibres, originated by such a fraying and the air-flow, may disturb both the adjoining working stations and those of other machines, thus causing sequential breakages of the threads or the tows being processed.

In addition, if an operator has not noticed the breakages, inasmuch as he must watch a certain number of machines, and thus is not alert to splice the broken threads or tows, a loss of material would be experienced since the threads or tows exiting the draw-frame are sucked by the tubes placed beneath the drafting section and are conveyed in the channel and collected in the machine filter box.

These shortcomings are most frequently experienced whenever threads or silvers having high gauges are processed, and, still more, when the high production speeds are adopted.

The object of the present invention is to do away with the shortcomings enumerated hereinabove by a device which is characterized in that it comprises means which feed the thread or the silver and which, as the thread or silver breaks, control spindle-stopping means, means for stopping the raw material feed upstream of the drawframe and means for signalling the occurrence of a break to an operator.

The sensing means (one for each working station) are placed in the zone between the drafting set and the thread guides and are electrically connected on one side to an electrical-pneumatic-mechanical device or electromagnetic devices for stopping the spindle rotation and, on the other side, to light pilot lamps to warn an operator that a break has occurred. Such devices are connected, by electrical or metallic cables, to mechanical or electro-magnetic apparatus for automatically stopping, upstream of the draw frame, the flow of the raw material.

Further features and advantages of the invention will become more clearly apparent from the description of a few embodiments, shown by way of nonlimiting example only, in the accompanying drawings, wherein:

FIG. 3 is a side elevational view of an electric-pneumatic-mechanical device for stopping the spindle rotation.

FIG. 4 is a top plan view of the device shown in FIG. 3.

FIG. 5 is a vertical cross-sectional view of the mechanical apparatus for stopping the raw material feed.

FIG. 6 is a side elevational view of the apparatus shown in FIG. 5.

FIG. 7 is a vertical cross-sectional view of the apparatus shown in FIG. 5 at the instant at which the raw material feed has been discontinued.

FIG. 9 shows the electric wiring diagram of the device, shown in FIG. 8.

Figures 1, 2:
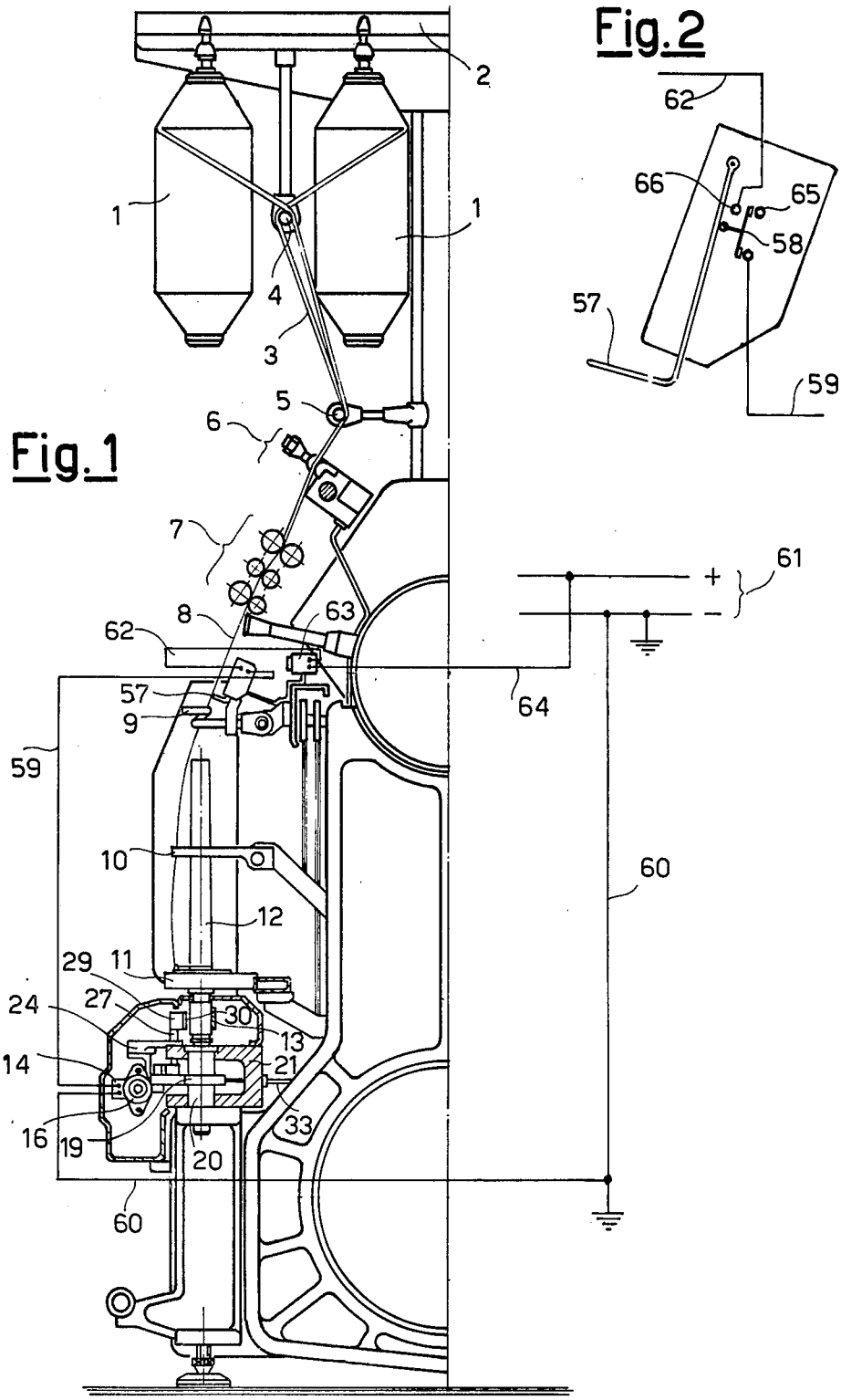
FIG. 1 is a vertical cross-sectional view of a spinning frame (one half only is shown) to which the device according to this invention has been applied.
FIG. 2 is a diagrammatical showing of the interior of the thread feeler.

Having now reference, at the outset, to FIG. 1, the vertical cross-section view of a ring frame is shown (one half only is depicted in the drawing) wherein the bobbins 1, coming from the previous processing step, are hung to the creel 2 and the silver 3, by means of the thread-diverters 4 and 5, is passed through a stopping unit 6 and the drafting section 7, wherein it is drafted, a thread 8 being thus obtained.

The thread 8 is passed through a thread guide 9, through an annular separator 10, the spinning ring 11 and is collected on the spindle 12, the latter being driven to rotation by a tangential belt 13.

It is to be borne in mind that all the component parts enumerated above are known, with the exception of the unit 6 which will be better described hereinafter.

The spindle-stopping device for any working position, according to the example shown in FIGS. 1, 3 and 4 hereof, comprises an electromagnetic valve 14, of the three-way type (viz.: closed, open, discharge) which, via a piping 15, is put in communication with a single-acting pneumatic ram 16. The stem 17 of the piston of such ram is connected, via a circular clamping member 19, applied to a bushing 20 having an eccentrical bore, in which the spindle 12 is inserted. The bushing 20 is mounted with a slight clearance on the spindle rail 21 of the frame.

The pneumatic ring 16 is fastened to the ring rail 21 by means of the screw 22, the nut 23, the supporting member 24 and the screw 25.

On the ring rail 21, near the supporting member 24, is mounted, by means of the screw 26, another supporting member 27 in the form of a bracket, on which is applied, by the screw 28, a leaf spring 29, the end of which has fastened thereto, a friction lining strap 30. The spring 29 and the friction lining 30 are a braking unit for stopping the spindle 12.

For each working position of the machine a device as described hereinabove is provided and the connection between the electromagnetic valves 14 is made by the tubes 31 and 32, the end tubing of which is connected either to a compressor (not shown) or to the compressed air main existing in the factory in which the ring frames are installed.

The clamping member 19 of the bushing 20 is connected, by a wire 33, to the unit 6 for stopping the raw material feed. Such unit is composed, according to the example shown in FIGS. 5, 6 and 7, by a pincer comprising an anvil piece 34 and a seating 40 therefor.

The anvil piece 34 is mounted, by means of a supporting member 35, on a rod 36 which is terminated by a plunger 37 and is connected by the coil spring 38 to the clamping member 39.

The anvil piece 34 is kept spaced apart from a seating 40 in which the sliver 3 slides prior to being drafted by the roller pair 7, by a plunger 41 which is connected to the clamping member 39 by means of a coil spring 42.

The plunger 41 carries a pin 43 on which is fulcrumed a leaf spring 44, and also a stopping dowel 45.

To the end of the wire 33 which enters the casing formed by the clamping member 39 and the sheet metal lids 46 and 47 fastened by screws 48 and 49 on said clamping member 39, is applied a coil spring 50 and a leaf spring 51 fulcrumed on a pin 52 which is positioned on the lid 47.

The casing is latched by the screws 53 and 54 on a rod 55 which is a part of the machine and in addition the seating 40 is fastened by the screw 56 to the clamping member 39.

It is to be borne in mind that the thread 8 emerging from the drafting set 7, prior to passing through the thread guide 9, presses a thread feeler wisker 57 which acts upon the movable contact 58 of a switch which is connected electrically, via a lead 59, to the electromagnetic valve 14, and, via a lead 62, to a pilot light 63. In addition, the electromagnetic valve 14, via a lead 50, and the pilot lamp 62, via a lead 64, are connected to the DC-main 61.

The operation of the device according to the invention is as follows.

As the thread 8 breaks, since the thread-sensing wisker 57 is no longer pressed by the thread 8, the movable contact 58 of the switch is switched from the position 65 to the position 66 so that the electric circuit is made for energizing the electromagnetic valve 14 and lighting the pilot lamp 63 via the leads 64, 62, 59 and 60.

The energization of the electromagnetic valve 14 opens the way for the flow of compressed air from the piping 32 to the piping 15 and thence to the pneumatic ram 16, so that the stem 17 of the ram urges the clamping member 19 so that the bushing 20 is swung through a certain angle and the spindle 12, by virtue of the swing of the bushing 20, does not contact any longer the tangential belt 13 and, on the contrary, it presses the friction lining 30 to become stopped (see FIG. 4, position at the left).

The pilot lamp 63, which is on, warns the operator that a thread has broken in the working position concerned. Concurrently, the swing of the bushing 20 and thus that of the clamping member 19 displaces the wire 33 so that its end which is positioned internally of the casing of the unit 6, is pulled back and thus the spring 50 becomes compressed and the leaf 51, by being rotated about the pivot 52, contacts the blade 44 and biases the plunger 41 backwards, the spring 42 being thus compressed.

The plunger 37 is now no longer abutted by the plunger 41 and is biased by the spring 38 so that it enters its casing again and thus the anvil piece 34 abuts the seating 40 and pinches the sliver 3: the latter, as pulled by the roller pair of the draw frame 7, breaks (see FIG. 7).

By so doing, as the thread 8 breaks, both the spindle rotation, and the tow feed in the working position where the break occurred are stopped automatically, quite independently of all the other working stations which are going on working: the lighting up of the pilot lamp warns the operator that a break occurred.

For splicing the broken thread, the operator manually sets apart the anvil piece 34 from its seating 40 and concurrently shifts the plunger 37, so that the plunger 41, urged by the spring 42, is restored to the starting position and tenders an abutment to the plunger 37. The operator then passes the sliver 3 in the drafting unit 7 and presses the thread-feeler whisker 57, so that the movable contact 58 is switched from the position 66 to the position 65, thus opening the electric circuit and deenergizing both the electromagnetic valve 14 and the pilot lamp 63, and as a result the compressed air flow is cut off. The stem 17, the clamping member 19 and the bushing 20 are restored to their starting positions and the spindle 12, no longer braked, contacts the belt 13 and resumes its rotation again.

As the clamping member 19 is reverted to its initial position, also the end of the wire 33 and thus the leaf 51 resume their starting positions once more.

Figure 8:
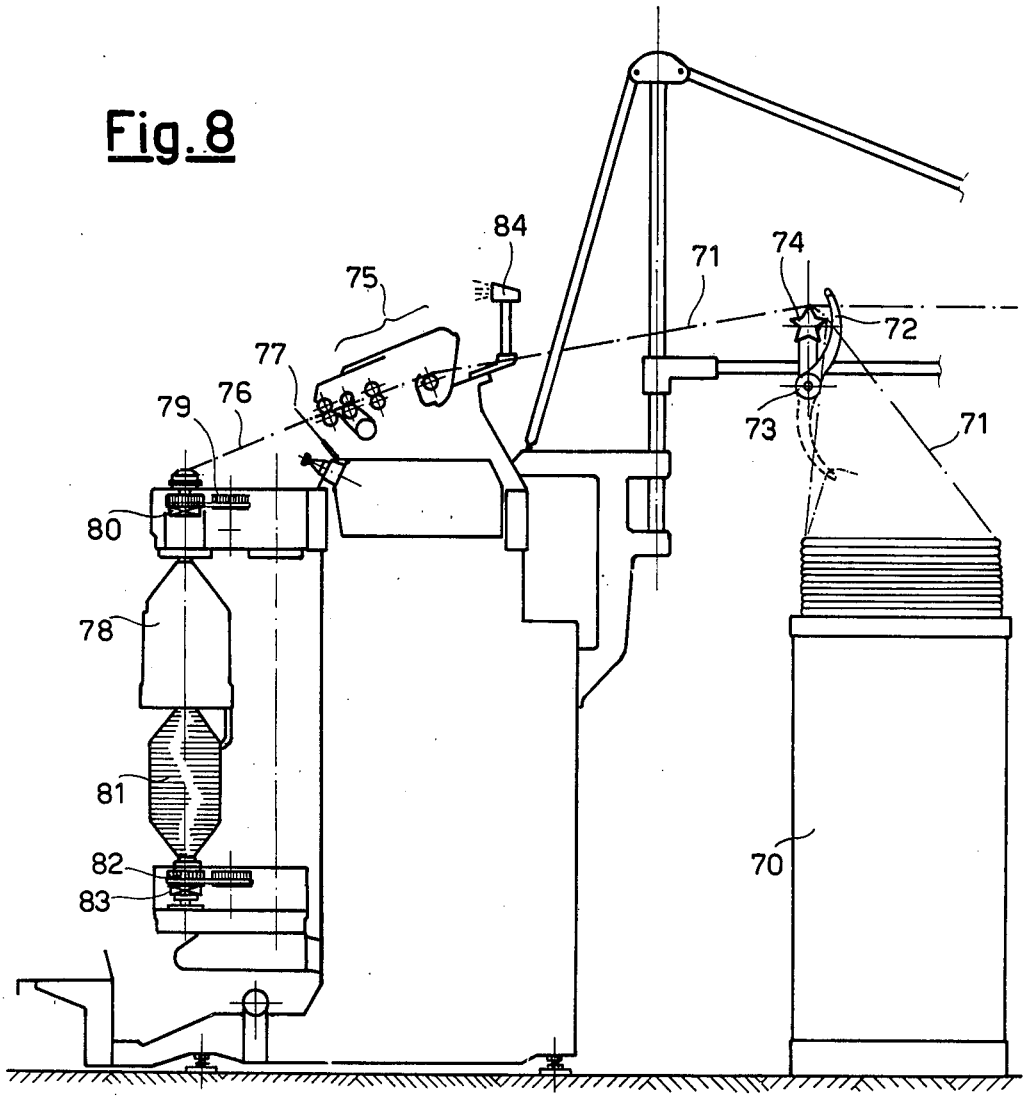
FIG. 8 is a diagrammatical vertical cross-sectional view of a fly frame to which the device of this invention has been applied.

FIGS. 8 and 9 show an alternative embodiment as applied for example to a spinning frame called a fly frame, in which the means for stopping the spindles, the flyers and the feed comprise electromagnetic clutches.

In this machine, from a can 70, the sliver 71 is passed through a sliver-guide 72, controlled by an electromagnetic clutch 73, over a roller 74 and is drafted in a draft unit 75.

As it exits the draft unit, the sliver 76 presses a thread feeling whisker 77, passes through the flyer 78 controlled by a linkage 79 also having an electromagnetic clutch 80, and is wrapped around the spindle 81 controlled by a linkage 82 also having an electromagnetic clutch 83.

The electromagnetic clutches 73, 80 and 83 and an indicator lamp 84, are electrically connected by leads, as shown in FIG. 9. The electric circuitry comprises a movable contact 85 of a switch actuated by the thread feeling whisker 77 and a relay 88 with a normally closed contact **88*a* and a normally open contact 88*b*. Finally, a main switch 89** is provided.

The operation of the embodiment described just now is as follows.

When the machine is running, the sliver 76 keeps the whisker 77 pressed and the latter acts upon the movable contact 85 of a switch and holds the contact in a position 86 wherein the electric circuit for energizing the electromagnetic clutches 73, 80 and 83 is closed.

As the sliver 76 breaks, the movable contact 85 is switched from position 86 to position 87, so as to deenergize the clutches 80 for the flyer and 83 for the spindle, whereby both remain inactive, whereas the electromagnetic clutch 73 of the silver-guide is de-energized only temporarily so as to allow the sliver guide to drop.

As the movable contact 85 of the sliver guide is in position 87, the relay 88 is energized and the latter, with its contact **88*b*, energizes the electromagnetic clutch 73 again, whereas the contact 88*a*, being opened, prevents the clutches 80 and 83 from being energized again. The indicator lamp 84**, when on, indicates to the operator the working station in which the fault took place.

When the operator has spliced the sliver 76, the whisker 77 restores the contact 85 from position 87 to position 86 and the spindle 81 with the flyer 78 resume their rotation, whereas the sliver guide 72 resumes its working position.

The advantages achieved with the device according to this invention can be summarized as follows:

- suppression of the sequential breaks of threads or slivers during processing and thus a higher output of the machine,
- suppression of loss of material in the suction section of the machine,
- reduction of manpower since an operator can be entrusted with a larger number of machines to watch, no more thread entanglement on the draft section (lower rollers).

I claim:

1. Spinning frame apparatus comprising a drawing section and a spindle in which sliver is passed from said drawing section to said spindle, a turnable support member upon which said spindle is mounted eccentrically, a tangential belt connected for driving said spindle in rotation, the apparatus further including means for trapping the sliver positioned upstream of said drawing section, a thread feeler positioned downstream of said drawing section, a brake, and means for turning said support member to disengage said spindle from said tangential belt and to cause it to engage said brake, an electric circuit including an electric switch with said thread feeler forming a part of said electric switch, a warning light connected to said electric switch, and control means for actuating said means for turning said support member, said support member connected to said trapping means to actuate said trapping means upon turning of said support member to disengage said spindle from said tangential belt.

2. The apparatus of claim 1, wherein said trapping means comprises a spring-loaded pincer mechanism.

* * * * *